US012612212B1

(12) United States Patent
Hu et al.

(10) Patent No.: US 12,612,212 B1
(45) Date of Patent: Apr. 28, 2026

(54) STORAGE BOX

(71) Applicant: MYEAGLE PTE. LTD., Singapore (SG)

(72) Inventors: Haoliang Hu, Shenzhen (CN); Junhao Wu, Ningbo (CN)

(73) Assignee: MYEAGLE PTE. LTD., Singapore (SG)

( * ) Notice: Subject to any disclaimer, the term of this patent is extended or adjusted under 35 U.S.C. 154(b) by 0 days.

(21) Appl. No.: 19/366,112

(22) Filed: Oct. 22, 2025

(51) Int. Cl.
*B65D 6/24* (2006.01)

(52) U.S. Cl.
CPC ..... *B65D 11/1873* (2013.01)

(58) Field of Classification Search
CPC ..... B65D 11/1866; B65D 11/1873; B65D 21/023; B65D 2519/00502; B65D 2519/00587; B65D 11/26
USPC ..... 220/1.5, 4.28, 4.33, 682, 683, 684, 693
See application file for complete search history.

(56) References Cited

U.S. PATENT DOCUMENTS 8,443,496 B2 * 5/2013 De La Fuente .... A61G 17/0136 27/27
2023/0117878 A1 * 4/2023 Jiang ..... B65D 43/169 220/4.33

FOREIGN PATENT DOCUMENTS

GB 2293594 A * 4/1996 ..... B65D 11/1873

* cited by examiner

*Primary Examiner* — Jeffrey R Allen
*Assistant Examiner* — Madison L Poos
(74) *Attorney, Agent, or Firm* — HOWARD M COHN and Associates, LLC

(57) ABSTRACT

A storage box includes a bottom board, a cover board, and side enclosing boards connected between the bottom board and the cover board. The bottom board, the cover board and the side enclosing boards jointly enclose to form a storage space. At least one of the cover board, the side enclosing boards, and the bottom board includes a first board and a second board spliced with the first board. A first splicing portion is disposed on a splicing side of the first board. A second splicing portion matched with the first splicing portion is disposed on a splicing side of the second board. The first splicing portion is spliced with the second splicing portion, and the first splicing portion overlaps the second splicing portion in a thickness direction.

17 Claims, 10 Drawing Sheets

STORAGE BOX

TECHNICAL FIELD

The present disclosure relates to a technical field of storage boxes and in particular to a storage box.

BACKGROUND

Storage boxes are widely used in industries such as machinery and electronics. The storage boxes are primarily configured to store items, facilitating easy turnover, neat stacking, and management of the items. Furthermore, the storage boxes are easy to clean. Due to a rational structural design and high quality, the storage boxes are widely used in logistics, including transportation, storage, and processing.

In the related art, for large-sized storage boxes, each board thereof is commonly a one-piece board, which results in the large-sized storage boxes taking up a significant amount of space during storage, leading to oversized packaging, inefficient transportation, and increased logistics costs.

For this reason, some manufacturers currently divide each board of the large-sized storage boxes into sub-boards. However, the sub-boards are commonly connected via hooks and grooves, which easily leads to low assembly stability of the large-sized storage boxes. As a result, the large-sized storage boxes have a risk of collapse.

SUMMARY

The present disclosure provides a storage box, which improves a connection stability of the storage box.

In a first aspect, the present disclosure provides the storage box. The storage box comprises a bottom board, a cover board, and side enclosing boards connected between the bottom board and the cover board. The bottom board, the cover board and the side enclosing boards jointly enclose to form a storage space. At least one of the cover board, the side enclosing boards, and the bottom board comprises a first board and a second board spliced with the first board. A first splicing portion is disposed on a splicing side of the first board. A second splicing portion matched with the first splicing portion is disposed on a splicing side of the second board. The first splicing portion is spliced with the second splicing portion, and the first splicing portion overlaps the second splicing portion in a thickness direction.

In the storage box, at least one of the cover board, the side enclosing boards, and the bottom board comprises the first board and the second board. The first splicing portion is disposed on the splicing side of the first board. The second splicing portion matched with the first splicing portion is disposed on the splicing side of the second board. The first splicing portion is spliced with the second splicing portion, and the first splicing portion overlaps the second splicing portion in the thickness direction.

The first board and the second board are assembled into a complete plate by connecting the first splicing portion to the second splicing portion. The first splicing portion and the second splicing portion are overlapped in the thickness direction, and a splicing surface of an overlapping portion thereof increases a contact area between the first splicing portion and the second splicing portion, thereby ensuring an overall structural strength of the complete plate. In this way, the storage box is allowed to bear great external force impact and pressure, which overcomes a problem of insufficient strength of a connection of sub-boards small board connection in a split-type storage box of the prior art. The overlapping portion of the first splicing portion and the second splicing portion in the thickness direction effectively blocks a penetration of moisture, thereby providing excellent moisture-proof protection for items in the storage box.

Furthermore, from a transportation and storage perspective, in the embodiment, each board of a large size is divided into the first board and the second board, significantly reducing storage space and facilitating stacking and management of the items stored therein. Moreover, oversized packaging during transportation is avoided, effectively reducing transportation costs and resolving transportation and storage issues of a board of a one-piece structure in the prior art. Furthermore, there's no need to increase the connection strength of the boards of the storage box by introducing mounting rods as is required in the prior art, which avoids an increase in the overall weight of the storage box, makes handling and installation of the storage box easier and more convenient, and expands potential applications of the storage box.

In a second aspect, the present disclosure provides the storage box. The storage box comprises a bottom board, a cover board, and side enclosing boards connected between the bottom board and the cover board.

The bottom board, the cover board and the side enclosing boards are enclosed to form a storage space. The bottom board comprises at least two sub-bottom boards spliced with each other. At least one of the side enclosing boards comprises at least two sub-boards spliced with each other. A splicing seam between the at least two sub-boards is staggered with a splicing seam between the at least two sub-bottom boards.

BRIEF DESCRIPTION OF DRAWINGS

In order to clearly describe technical solutions in the embodiments of the present disclosure, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor.

In the drawings.

Figure 1:
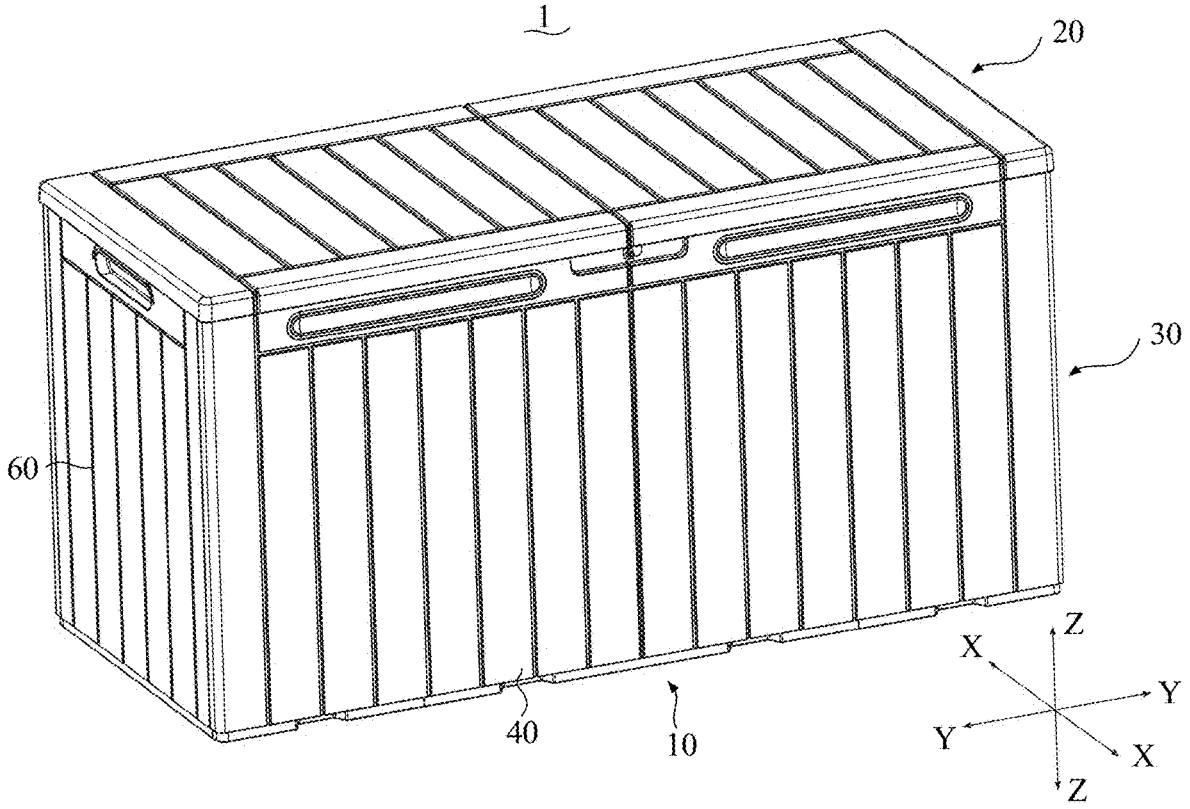
FIG. 1 is a schematic diagram of a storage box according to one embodiment of the present disclosure.

1—storage box; 100—first board; 110—first splicing portion; 111—first plate; 112—first connecting portion; 1121—snapping portion; 1124—first hook; 1123—second hook; 1122—first fixing hole; 113—first protrusion portion; 114—second protrusion portion; 115—mounting groove; 116—first positioning portion; 200—second board; 210—second splicing portion; 211—second plate; 212—second connecting portion; 2121—snapping groove; 2122—second fixing hole; 213—waterproof groove; 214—boss; 215—second positioning portion; 10—bottom board; 11—sub-bottom board; 12—first sub-bottom board; 13—second sub-bottom board; 14—third sub-bottom board; 16—receiving groove; 141—limiting portion; 15—finger slot; 20—cover board; 21—first sub-cover board; 22—second sub-cover board; 30—side enclosing board; 31—sub-board; 40—front board; 41—first sub-front board; 42—second sub-front board; 50—back board; 51—first sub-back board; 52—second sub-back board; 60—left side board; 70—right side board; 81—first fixing rod; 82—second fixing rod; 83—connecting rod.

The realization of the objectives, functional features and characteristics of the present disclosure is further explained in conjunction with embodiments and with reference to the accompanying drawings.

DETAILED DESCRIPTION

In order to make the purpose, technical solutions, and advantages of the present disclosure clear, the following section will further describe the embodiments of the present disclosure in detail with reference to the accompanying drawings.

When the following description refers to the drawings, the same numbers in different drawings refer to the same or similar elements unless otherwise indicated. The implementations described in the following exemplary embodiments do not represent all implementations consistent with the present disclosure. Rather, they are merely examples of apparatus and methods consistent with certain aspects of the present disclosure, as detailed in the appended claims.

It should be understood in the description of the present disclosure that terms such as "first" and "second" are only used for the purpose of description, rather than being understood to indicate or imply relative importance or hint the number of indicated technical features. Thus, the feature limited by "first" and "second" can explicitly or implicitly comprise at least one feature. Unless otherwise indicated, the term "a plurality of" means two or more. The term "and/or" depicts the relationship between associated objects and there are three relationships thereon. For example, A and/or B may indicate A exists alone, A and B exist at the same time, and B exists alone. The character "/" generally indicates that the associated object is alternative. The terms "first", "second", "third", etc. in the present disclosure are used only to distinguish similar objects and do not imply a specific ordering of objects.

Unless otherwise defined, all technical and scientific terms used herein have the same meaning as commonly understood by those skilled in the art of the present disclosure. The terminology used in the specification is for the purpose of describing specific embodiments only and is not intended to limit the present disclosure. As used herein, the term "and/or" comprises any and all combinations of one or more of the associated listed items.

As shown in FIG. 1, the present disclosure provides the storage box. The storage box comprises a bottom board 10, a cover board 20, and side enclosing boards 30 connected between the bottom board 10 and the cover board 20. The bottom board 10, the cover board 20 and the side enclosing boards 30 are enclosed to form a storage space. The storage box 1 is configured as a cuboid, which meets most usage scenarios. Of course, in other embodiments, the storage box 1 may be configured as a polygon, such as a hexagon, an octagon, or a pentagon, etc., which is not limited thereto.

Taking a coordinate system in FIG. 1 as an example, the storage box defines a height direction ZZ, a length direction YY, and a width direction XX, and the height direction ZZ, the length direction YY, and the width direction XX are perpendicular to each other.

Figure 2:
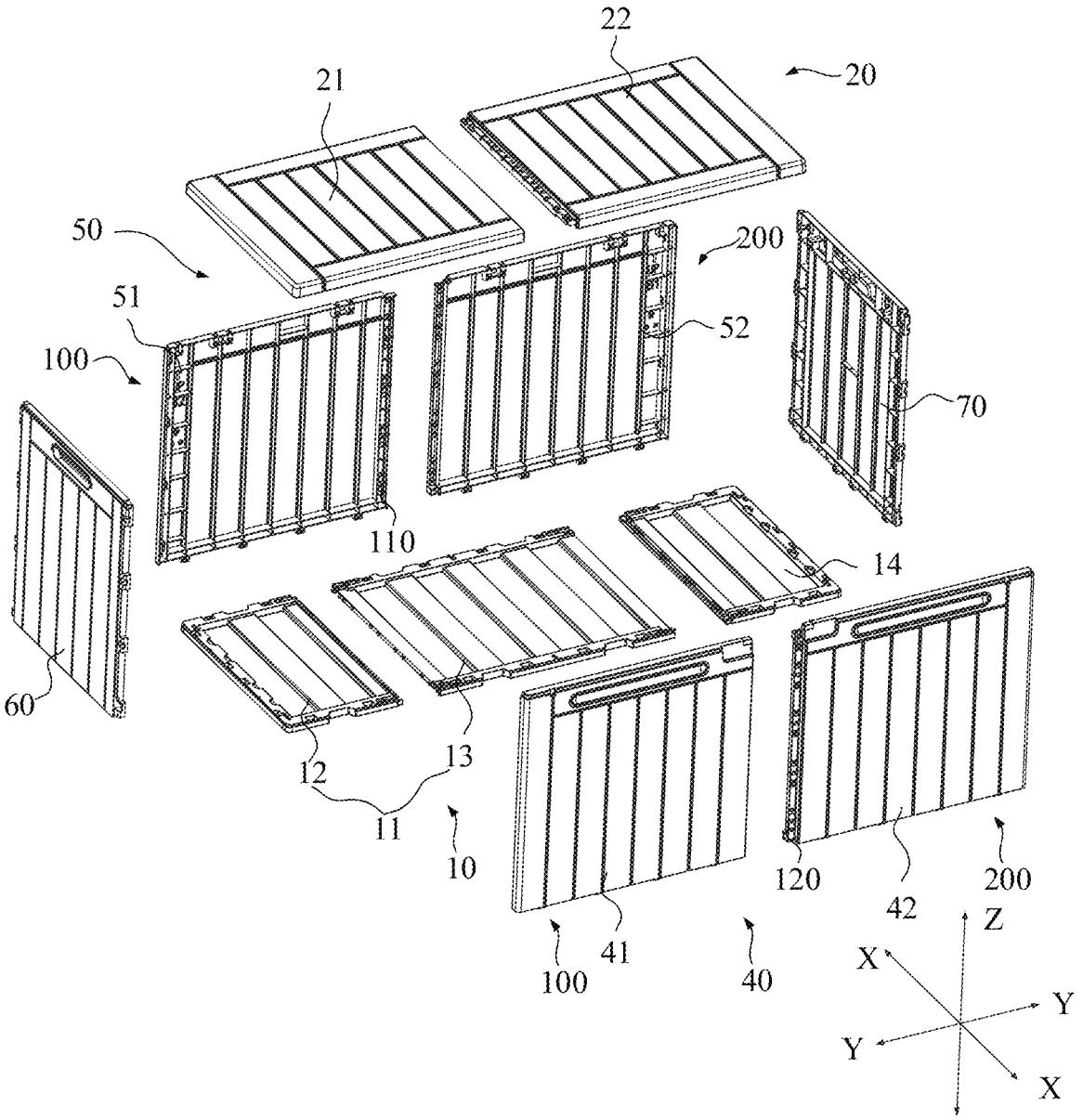
FIG. 2 is an exploded schematic diagram of the storage box according to one embodiment of the present disclosure.
Figure 3:
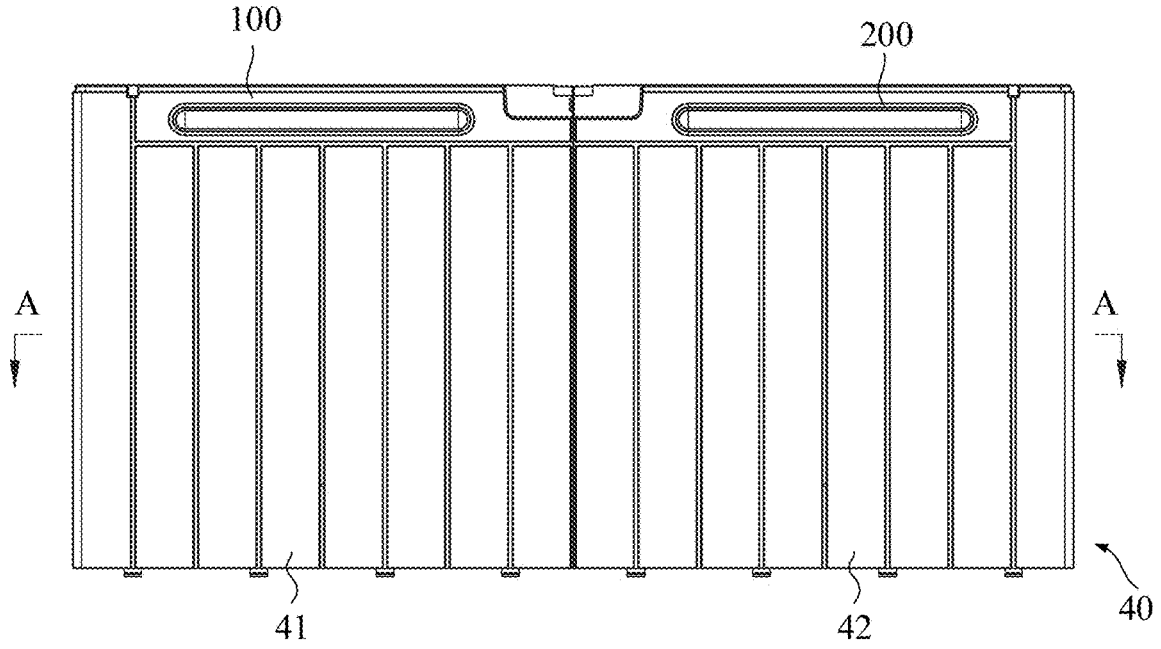
FIG. 3 is a schematic diagram of a front board according to one embodiment of the present disclosure.
Figure 4:
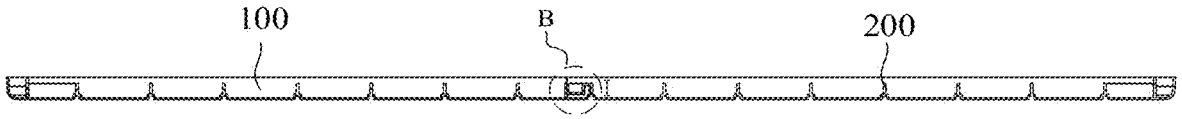
FIG. 4 is a cross-sectional schematic diagram of the front board taken along a line A-A shown in FIG. 3.
Figure 5:
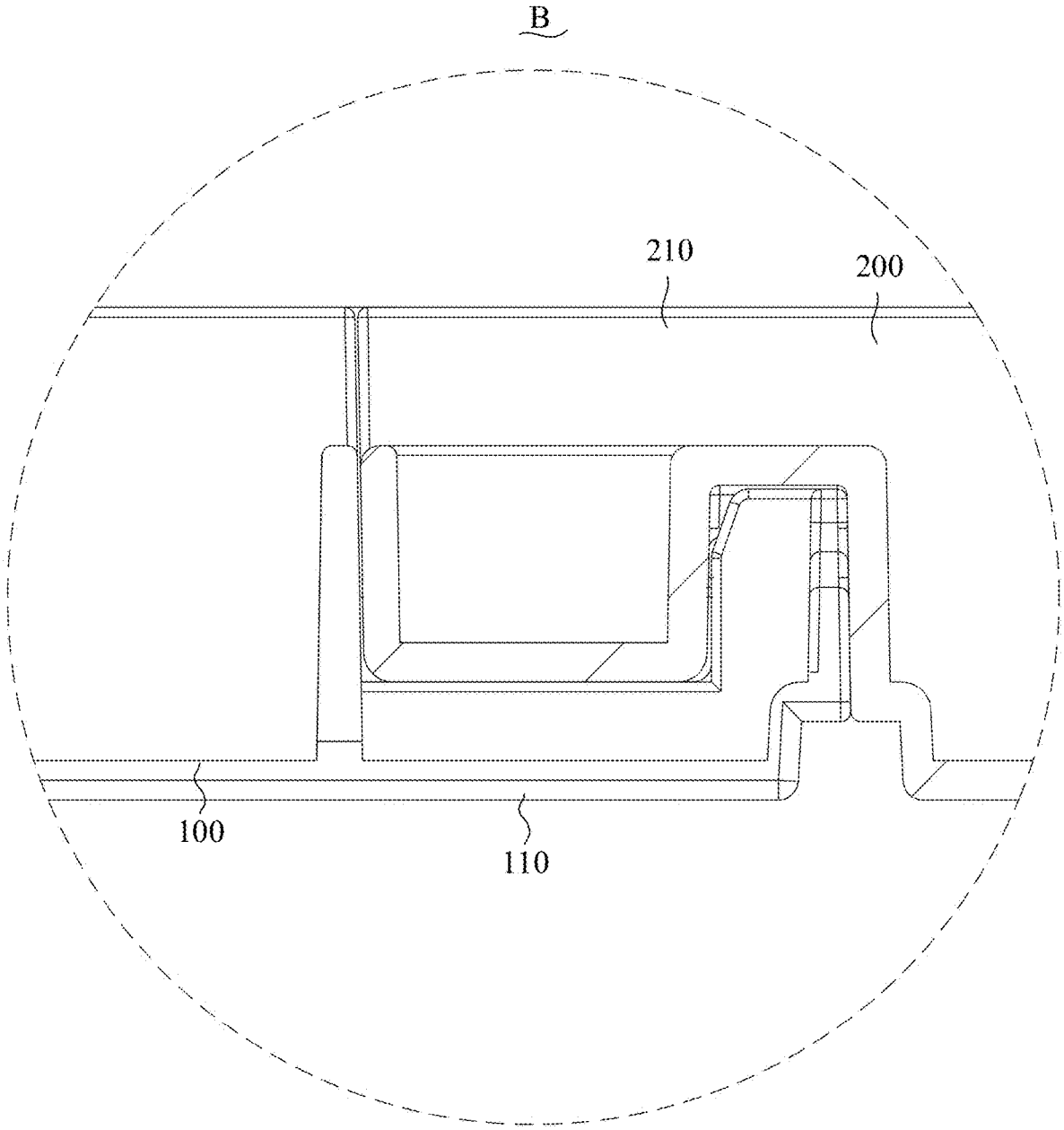
FIG. 5 is an enlarged schematic diagram of portion B shown in FIG. 4.
Figure 6:
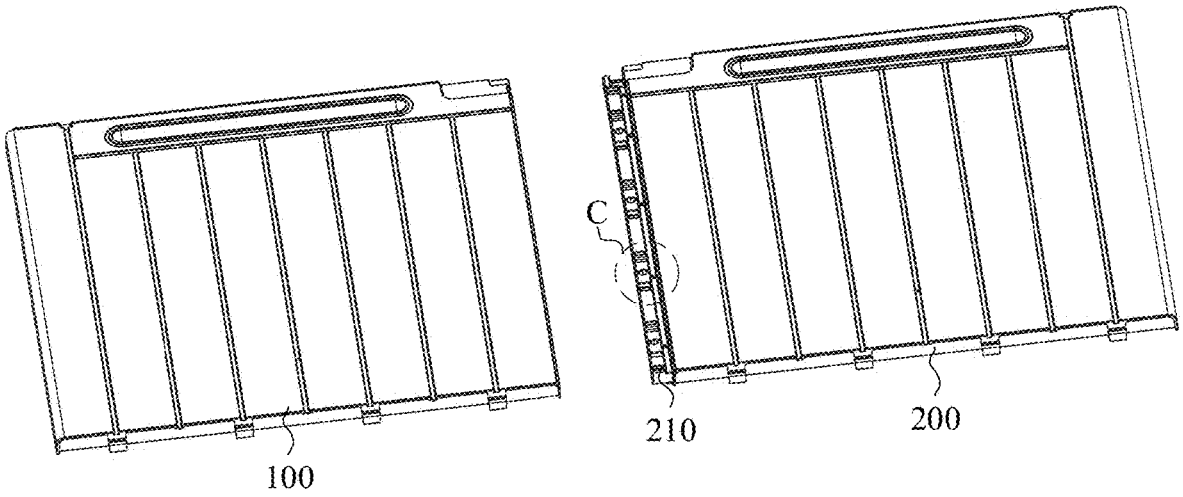
FIG. 6 is an exploded schematic diagram of the front board according to one embodiment of the present disclosure.

Taking the storage box 1 as the cuboid as an example, as shown in FIG. 2, the side surrounding boards 30 comprise a front board 40, a left side board 60, a right side board 70, and a back board 50. The bottom board 10 and the cover board 20 are disposed in parallel in the height direction ZZ. The left side board 60 and the right side board 70 are disposed in parallel in the length direction YY The front board 40 and the back board 50 are disposed in parallel in the width direction XX. The left side board 60, the right side board 70, the front board 40 and the back board 50 are disposed between the bottom board 10 and the cover board 20 to enclose the storage space.

The left side board 60, the right side board 70, the front board 40, and the back board 50 are connected by snapping fasteners. Specifically, the left side board 60 and the right side board 70 are installed to the front board 40 by corresponding snapping fasteners, and the back board 50 is fixed to the left side board 60 and the right side board 70 by corresponding snapping fasteners. At this time, a rectangular frame is formed. Corresponding snapping fasteners are disposed on bottom portions of the left side board 60, the right side board 70, the front board 40, and the bottom of the back board 50, and hole positions are defined in the bottom board 10 is provided with a hole position. Then, the corresponding snapping fasteners disposed on a bottom portion of the rectangular frame are aligned and snapped with the hole positions of the bottom board 10, Finally, the cover board 20 is rotatably connected with a top portion of the back board 50, thereby achieving an installation of the storage box 1

In the related art, for a large-sized storage box, a bottom board, a cover board, a front board, a back board 50 and other board components thereof generally adopt are commonly one-piece boards. The one-piece boards have a large size, which results in the large-sized storage box taking up a significant amount of space during storage, leading to oversized packaging. The one-piece boards not only lead to a significant reduction in packing volume of large-sized storage boxes and low transportation efficiency, but also generates higher additional freight charges due to oversize issues in a final delivery stage, increasing overall logistics costs.

For this reason, some manufacturers currently divide each of boards of the large-sized storage box into sub-boards. However, during assembling, it is necessary to connect the sub-boards into a single board, then the boards composed of the sub-boards are connected to form the large-sized storage box. In the prior art, snapping structures or plug-in structures are disposed on edges of the sub-boards. However, a connection strength of the large-sized storage box after assembly is relatively low, making it difficult to meet the stability and durability requirements of the large-sized storage box in actual use. To improve the connection strength of the sub-boards, mounting brackets are introduced in some designs, and the mounting brackets are installed between the sub-boards. However, the mounting brackets significantly increase an overall weight of the large-sized storage box, making the large-sized storage box difficult to carry and install.

To solve technical problems in the prior art, the embodiment improves a design of boards of the storage box. In the embodiment, at least one of the bottom board 10, the cover board 20, the front board 40, the left side board 60, the right side board 70 and the back board 50 comprises a first board 100 and a second board 200. Each second board 200 is spliced with a corresponding first board 100 to form a complete board. In this way, an overall size of the storage box 1 of a large size is guaranteed and a space occupied by the storage box during transportation or storage is reduced. Of course, in other embodiments, according to specific needs, each complete board is formed by splicing three or more boards, that is, each complete board may comprise a third board, a fourth board, etc., which is not limited thereto.

Figure 9:
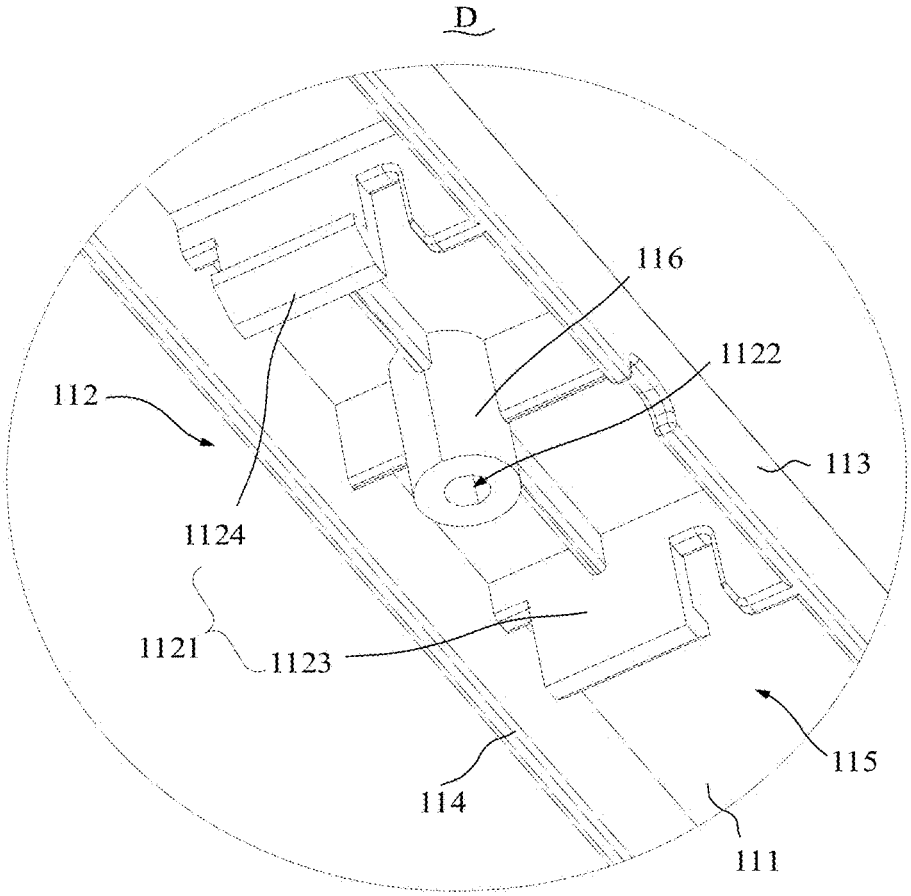
FIG. 9 is an enlarged schematic diagram of portion D shown in FIG. 8.

As shown in FIGS. 9-9, the present disclosure takes the front board 40 as an example for illustration. The front board 40 is formed by two boards (the first board 100 and the second board 200) spliced with each other. A first splicing portion 110 is disposed on a splicing side of the first board 100. A second splicing portion 210 matched with the first splicing portion 110 is disposed on a splicing side of the second board 200. The first splicing portion 110 is spliced with the second splicing portion 210, and the first splicing portion 110 overlaps the second splicing portion 210 in a thickness direction.

The first board 100 and the second board 200 are assembled into a complete board (e.g., the front board 40) through the first splicing portion 110 and the second splicing portion 210. Specifically, the first board 100 and the second board 200 each have a main board portion. One side of the main board portion of the first board 100 is connected with the first splicing portion 110, and one side of the main board portion of the second board 200 is connected with the second splicing portion 210. When the first splicing portion 110 and the second splicing portion 210 are connected and fixed, the main board portion of the first board 100, the main board portion of the second board 200, and an overlapping portion of the first splicing portion 110 and the second splicing portion 210 together form a complete board (e.g., the front board 40).

The first splicing portion 110 overlaps the second splicing portion 210 in the thickness direction. A splicing surface of the overlapping portion thereof increases a contact area between the first splicing portion 110 and the second splicing portion 210, thereby ensuring an overall structural strength of the complete board. In this way, the storage box is allowed to bear great external force impact and pressure, which overcomes a problem of insufficient strength of a connection of sub-boards small board connection in a split-type storage box of the prior art. The overlapping portion of the first splicing portion 110 and the second splicing portion 210 in the thickness direction effectively blocks a penetration of moisture, thereby providing excellent moisture-proof protection for items in the storage box. Furthermore, from a transportation and storage perspective, in the embodiment, each board of a large size is divided into the first board 100 and the second board 200, significantly reducing storage space and facilitating stacking and management of the items stored therein. Moreover, oversized packaging during transportation is avoided, effectively reducing transportation costs and resolving transportation and storage issues of a board of a one-piece structure in the prior art. Furthermore, there's no need to increase the connection strength of the boards of the storage box by introducing mounting rods as is required in the prior art, which avoids an increase in the overall weight of the storage box, makes handling and installation of the storage box 1 easier and more convenient, and expands potential applications of the storage box 1.

Figure 7:
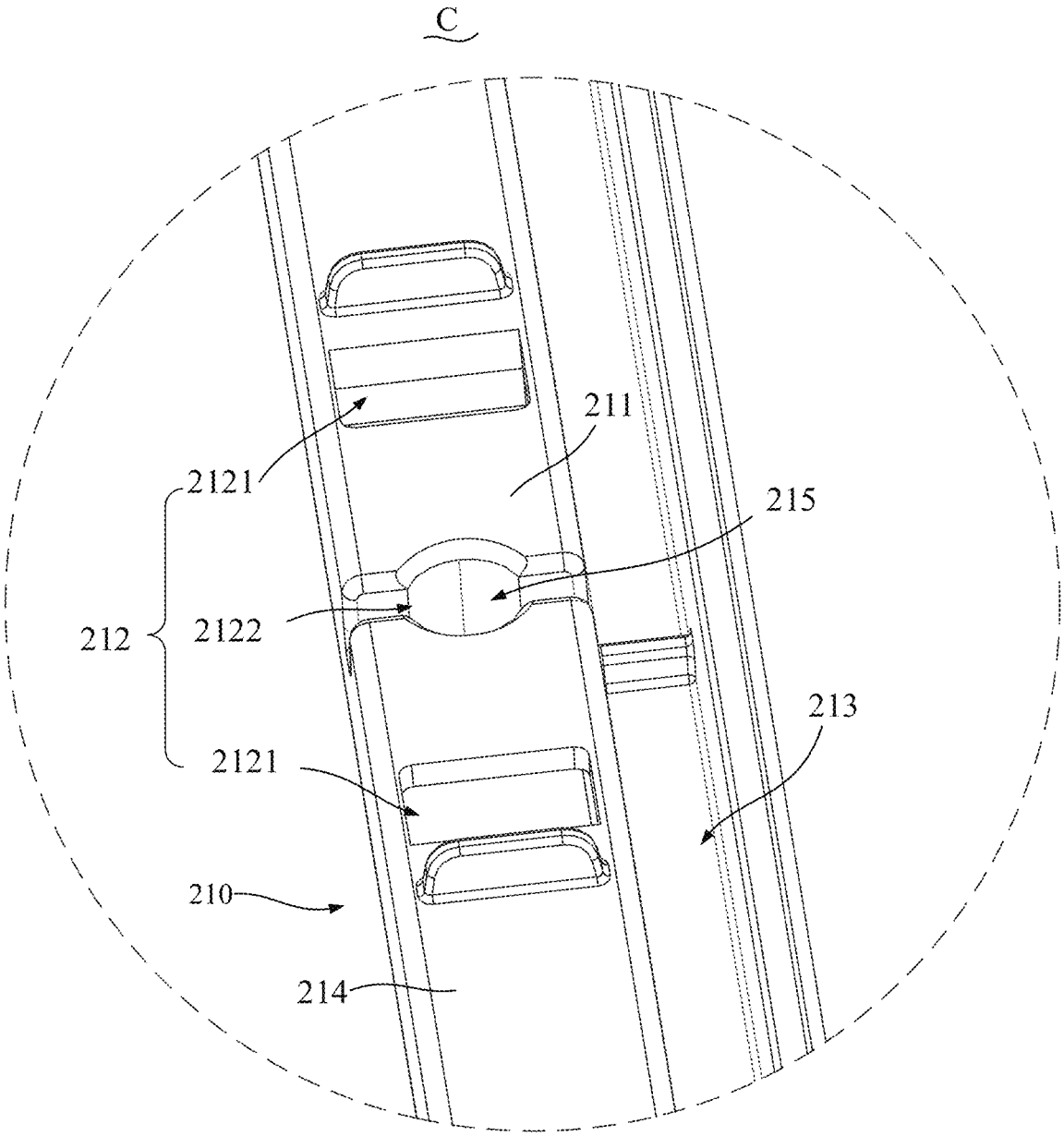
FIG. 7 is an enlarged schematic diagram of portion C shown in FIG. 6.

As shown in FIGS. 7 and 9, the first splicing portion 110 comprises a first plate 111, the second splicing portion 210 comprises a second plate 211, and the first plate 111 and the second plate 211 are overlapped in the thickness direction. At least one first connecting portion 112 is disposed on the first plate 111, at least one second connecting portion 212 is disposed on the second plate 211, and the at least one first connecting portion 112 is connected with the at least one second connecting portion 212 to fix the first plate 111 to the second plate 211 relative to each other. The first plate 111 and the second plate 211 are relatively fixed to ensure an integrity of the complete board after splicing, making the complete board stable and reliable.

Figure 8:
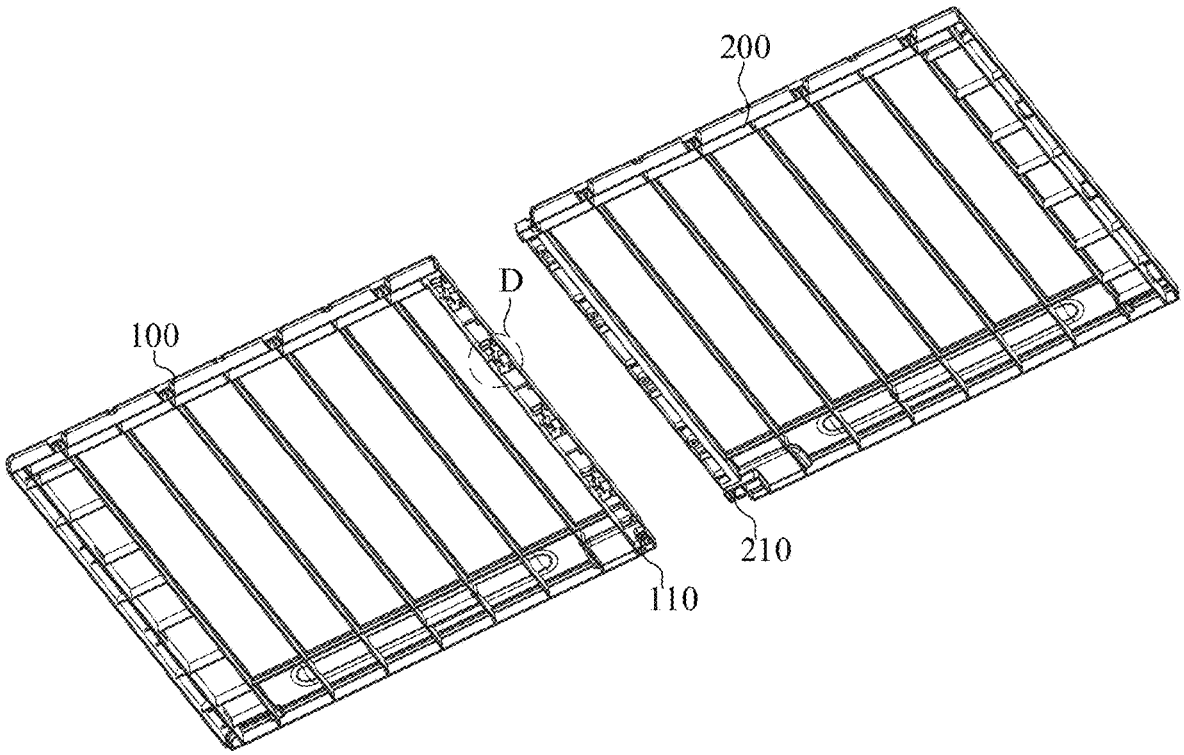
FIG. 8 is another exploded schematic diagram of the front board according to one embodiment of the present disclosure.

As shown in FIGS. 7-9, in some embodiments, the second plate 211 is recessed in a direction away from the first plate 111 (i.e., a direction toward the main board portion of the second board 200) to define a waterproof groove 213. The waterproof groove 213 extends in a length direction of the second plate 211. That is, the waterproof groove 213 extends along an edge where the first plate 111 and the second plate 211 are connected. In addition, the second plate 211 further comprises a boss 214 protruding from one side of the waterproof groove 213, and the at least one first connecting portion 112 is connected to the boss 214. The first plate 111 comprises a first protrusion portion 113, and the first protrusion portion 113 is engaged in the waterproof groove 213. The first protrusion portion 113 cooperates with the waterproof groove 213 and the boss 214 to effectively reduce a possibility of water infiltration through the edge where the first plate 111 and the second plate 211 are connected.

As shown in FIGS. 7 and 9, in some embodiments, the first plate 111 further comprises a second protrusion portion 114. The first protrusion portion 113 and the second protrusion portion 114 are spaced apart to define a mounting groove 115 therebetween. The boss 214 is connected in the mounting groove 115. In this way, the waterproof sealing performance of the edge where the first plate 111 and the second plate 211 is greatly improved.

As shown in FIGS. 7 and 9, in some embodiments, the at least one first connecting portion 112 comprises at least one snapping portion 1121 disposed on the first plate 111. The at least one second connecting portion 212 comprises at least one snapping groove 2121 disposed on the second plate 211. The at least one snapping portion 1121 is snapped in the at least one snapping groove 2121. During installation, an operator only needs to align the at least one snapping portion 1121 on the first plate 111 with the at least one snapping groove 2121 on the second plate 211 and apply a certain amount of pressure, and the at least one snapping portion 1121 may automatically snap into the at least one snapping groove 2121 to achieve a quick connection. The installation method is simple and greatly shortens an installation time.

As shown in FIGS. 7 and 9, in some embodiments, the at least one snapping portion 1121 comprises a first hook 1124 and a second hook 1123. The first hook 1124 and the second hook 1123 are spaced apart in a length direction of the first plate 111. An orientation of the first hook 1124 is opposite to an orientation of the second hook 1123, and the first hook 1124 and the second hook 1123 are respectively hooked in the at least one snapping groove 2121. In some embodiments, each snapping groove 2121 is a single snapping groove, with the first hook 1124 and the second hook 1123 snapped into the single snapping groove 2121. In other embodiments, each snapping groove 2121 comprises two sub-grooves, with the first hook 1124 and the second hook 1123 respectively snapped into the two sub-grooves. The two hooks with different orientations exert force on the at least one snapping groove 2121 from two directions, forming a mutually constrained snap connection. Compared to a hook in a single direction, the two hooks effectively prevent relative displacement of the first plate 111 and the second plate 211 in multiple directions, greatly enhancing the firmness and stability of the connection. Furthermore, when a tensile force acts on connection positions of the two hooks and the at least one snapping groove, the two hooks with different orientations better disperse the tensile force, making it difficult for the two board bodies to separate when subjected to the tensile force. In this way, an overall pullout resistance of the complete board is improved, and the storage box 1 is suitable for scenarios requiring high connection strength.

As shown in FIGS. 7 and 9, in some embodiments, the at least one first connecting portion 112 comprises at least one first fixing hole 1122 disposed on the first plate 111. The at least one second connecting portion 212 comprises at least one second fixing hole 2122 defined on the second plate 211. The storage box further comprises at least one fastener (not shown), and the at least one fastener passes through the at least one first fixing hole 1122 and the at least one second fixing hole 2122 to fix the first plate 111 to the second plate 211. The at least one fastener may be a screw, a bolt, etc. Such a connection method withstands large tensile force, compressive force, and shear force, and reduces the possibility of the first board 100 and the second board 200 being loose or separated, thereby providing a stable structural support for the storage box 1 and ensuring that the storage box 1 is able to safely and reliably carry the items.

It should be noted that, in addition to the two connection methods mentioned above, the first plate 111 and the second plate 211 may be connected by plug-in connection, rivet connection, snap-on connection, etc. For instance, the connection methods of the first plate 111 and the second plate 211 comprise the snap-on connection method and the fastener connection method. In other embodiments, one of the two connection methods is selected, or both the two connection methods are applied, or more connection methods are used in combination, which are not limited thereto and the operator is able to choose the connection methods according to specific needs.

In some embodiments, at least one of the at least one first fixing hole 1122 and the at least one second fixing hole 2122 is a threaded hole, and the at least one fastener is the screw. In some embodiments, the at least one first fixing hole 1122 is configured as a smooth hole, and the at least one second fixing hole 2122 is configured as the threaded hole. Alternatively, the at least one first fixing hole 1122 is configured as the threaded hole, and the at least one second fixing hole 2122 is configured as the smooth hole. The at least one fastener is the screw. During assembly, the screw passes through the smooth hole and is tightened into the threaded hole, thereby securely connecting the first plate 111 and the second plate 211. In other embodiments, both the at least one first fixing hole 1122 and the at least one second fixing hole 2122 are configured as threaded holes, and the thread specifications of the at least one first fixing hole 1122 and the at least one second fixing hole 2122 are the same. During assembly, the screw is screwed into the at least one first fixing hole 1122 and the at least one second fixing hole 2122, thereby achieving connection of the first plate 111 and the second plate 211.

Furthermore, in the embodiment, when the first plate 111 or the second plate 211 are jointly configured as an outer surface of the complete board, the at least one first fixing hole 1122 and the at least one second fixing hole 2122 are blind holes that do not penetrate through the outer surface of the complete board, which improve the waterproof performance of the storage box 1, effectively preventing moisture from penetrating an interior of the storage box 1 through the fixing holes. Furthermore, the fixing holes maintain a smooth and even outer surface of the complete board, enhancing an overall aesthetics of the storage box 1. Compared to a case where the at least one fastener is the bolt (which requires nuts for a secure connection), the bolt must pass through the first plate 111 and second plate 211, which makes it extremely easy for the moisture to enter the interior of the storage box 1 through the at least one first fixing hole 1122 and the at least one second fixing hole 2122, increasing a risk of moisture contamination of the items disposed inside the storage box 1.

It should be further noted that the connection method mentioned above is to install the at least one fastener on an inner side of the storage box 1, which not only maintains the outer surface of the front board of the storage box 1 to be flat and smooth and improves the overall aesthetics, but also provides a certain degree of protection for the at least one fastener, thereby preventing the at least one fastener from contacting with the external environment, reducing the possibility of rust of the at least one fastener, and extending the service life of the at least one fastener. Of course, in other embodiments, the at least one fastener may be installed on the outer side of the storage box 1 according to actual needs. In this case, the fixing holes of the first plate 111 or the second plate 211 forming the inner surface of the complete board do not need to penetrate through the inner surface of the complete board. In this way, a waterproof effect is achieved. Of course, the embodiment is not limited thereto.

As shown in FIGS. 7-9, in some embodiments, the first plate 111 comprises at least one first positioning portion 116. The second plate 211 comprises at least one second positioning portion 215. The at least one first fixing hole 1122 is defined in the at least one first positioning portion 116. The at least one second fixing hole 2122 is defined in the at least one second positioning portion 215. The at least one first positioning portion 116 is in positioning fit with the at least one second positioning portion 215, and the at least one first fixing hole 1122 is aligned with the at least one second fixing hole 2122.

In the embodiment, through the positioning and cooperation of the at least one first positioning portion 116 and the at least one second positioning portion 215, the operator is able to quickly and accurately align the two board bodies, so that the at least one first fixing hole 1122 and the at least one second fixing hole 2122 are precisely aligned, thereby avoiding installation deviations caused by inaccurate manual alignment, and ensuring the quality and stability of the connection of the two board bodies. Moreover, the positioning and cooperation of the at least one first positioning portion 116 and the at least one second positioning portion 215 limits a relative movement between the first plate 111 and the second plate 211, so that the two board bodies form the complete board of a stale structure after connection. When subjected to external force, the at least one first positioning portion 116 and the at least one second positioning portion 215 withstand partial stress, reducing the load borne by the at least one first fixing hole 1122, the at least one second fixing hole 2122 and the at least one fastener, thereby reducing the risk of loosening of the connection between the first board 100 and the second board 200.

As shown in FIGS. 7 and 9, in some embodiments, one of the at least one first positioning portion 116 and the at least one second positioning portion 215 is a positioning column, and the other is a positioning groove. At least a portion of the positioning column is inserted into the positioning groove. For example, the at least one first positioning portion 116 is the positioning column, and the at least one second positioning portion 215 is the positioning groove. The at least one second fixing hole 2122 is communicated with the positioning groove. When the positioning column is inserted into the positioning groove, the at least one first fixing hole 1122 and the at least one second fixing hole 2122 are aligned. In other embodiments, the at least one first positioning portion 116 and the at least one second positioning portion 215 only play a positioning function, while the at least one first fixing hole 1122 and the at least one second fixing hole 2122 are positioned elsewhere on the first plate 111 and the second plate 211, which is not limited thereto.

As shown in FIGS. 7 and 9, in some embodiments, the at least one snapping portion 1121 comprises snapping portions 1121. The at least one first fixing hole 1122 comprises first fixing holes 1122. The snapping portions 1121 are disposed at intervals in the length direction of the first plate 111. Each of the first fixing holes 1122 is disposed between the first hook 1124 and the second hook 1123 of a corresponding one of the snapping portions 1121. Specifically, the snapping portions 1121 are spaced apart along the length direction of the first plate 111, enabling the first plate 111 to be connected and secured to the second plate 211 from a plurality of locations. Compared to a single snapping portion 1121, the snapping portions 1121 more evenly distribute force, ensuring a more stable connection between the two board bodies, which effectively prevents damage to the snapping portions 1121 or loosening of the connection between the two board bodies due to localized excessive force, thereby enhancing the overall deformation resistance of the complete board. Each of the first fixing holes 1122 is disposed between the first hook 1124 and the second hook 1123 of the corresponding one of the snapping portions 1121. When fasteners are provided to further secure the two board bodies through the first fixing holes 1122, the tension force generated by the fasteners complements the securing force of the snapping portions 1121. It is understood that a certain amount of deformation space is required between the first hook 1124 and the second hook 1123 of each of the snapping portions 1121. Positioning each of the first fixing holes 1122 between the first hook 1124 and the second hook 1123 of the corresponding one of the snapping portions 1121 fully utilizes a space within each of the snapping portions 1121, making the complete board more compact and reasonable in structure. The complete board achieves the dual functions of snap connection and bolt fixing within a limited space, avoiding a bloated structure or space waste that would result from only providing the fixing holes, thereby improving space utilization.

In the embodiment, the boards described above and below are allowed to be manufactured by an injection molding process. The injection molding process provides high structural strength and ensures machining accuracy of the snapping portions 1121 and the first fixing holes 1122 or the second fixing holes 2122. An injection molding material is selected from common, high-performance plastic materials such as, but not limited to, polypropylene (PP), polycarbonate (PC), and polyvinyl chloride (PVC).

Figure 10:
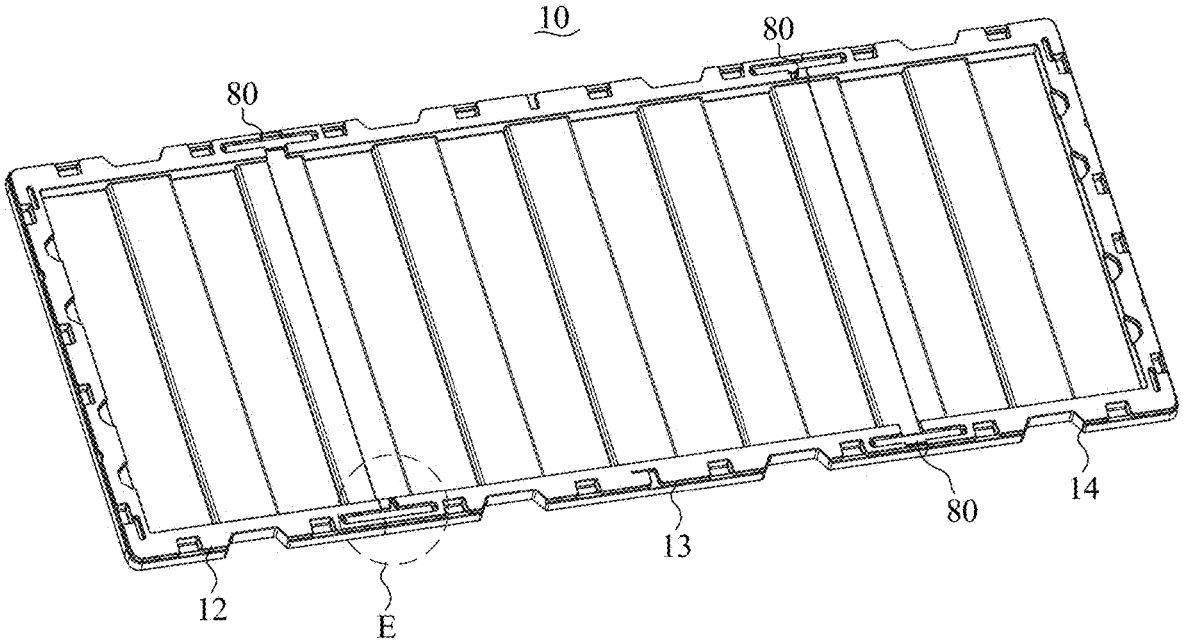
FIG. 10 is a schematic diagram of a bottom board according to one embodiment of the present disclosure.
Figure 11:
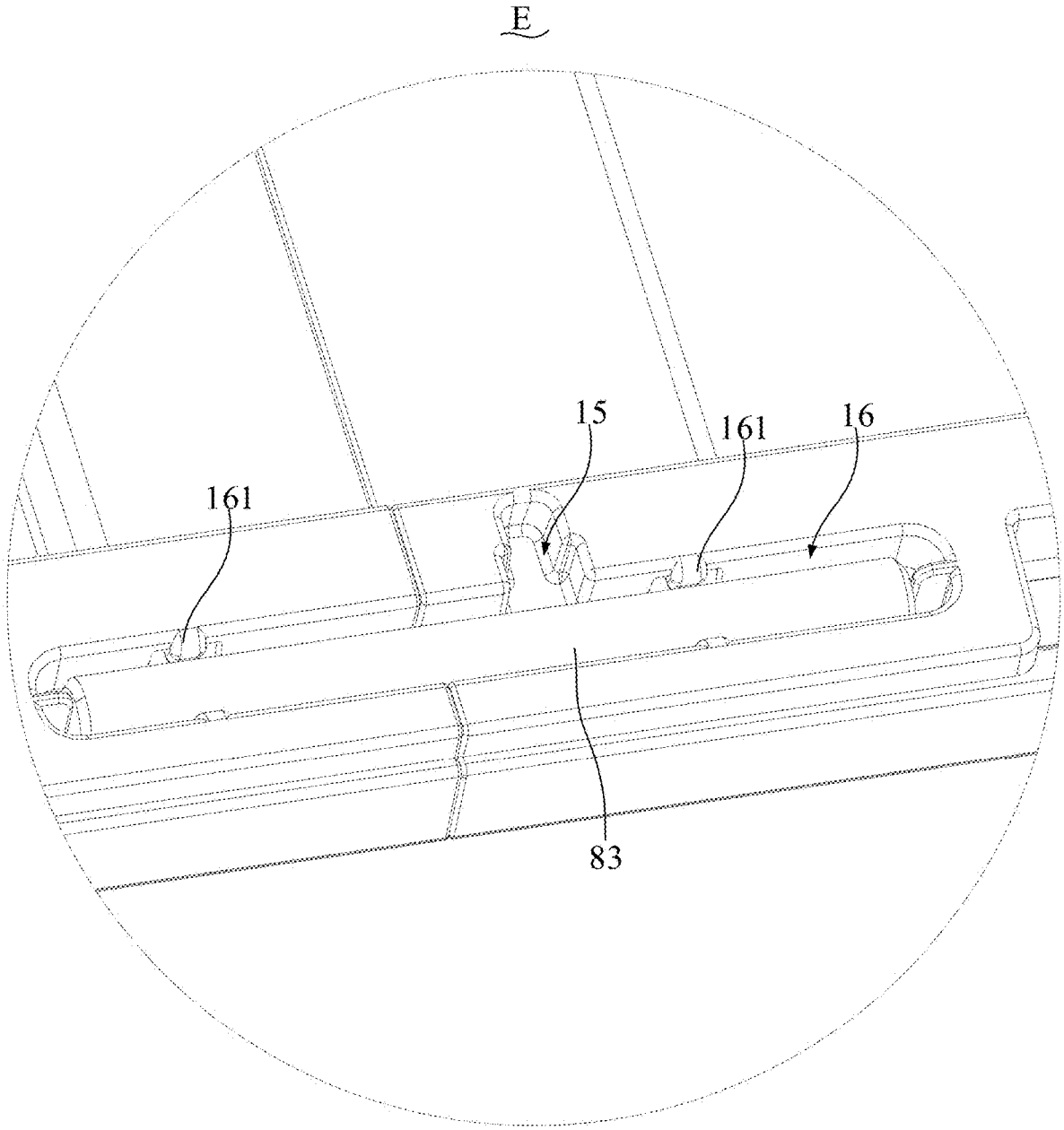
FIG. 11 is an enlarged schematic diagram of portion E shown in FIG. 10.
Figure 12:
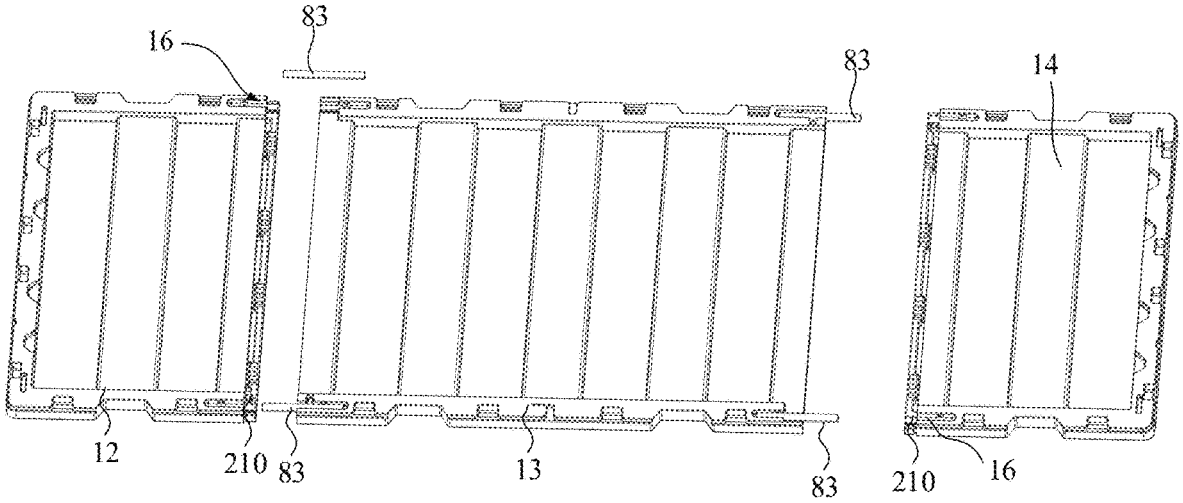
FIG. 12 is an exploded schematic diagram of the bottom board according to one embodiment of the present disclosure.

As shown in FIGS. 10-12, the bottom board 10 comprises a first sub-bottom board 12, a second sub-bottom board 13, and a third sub-bottom board 14. The first sub-bottom board 12, the second sub-bottom board 13, and the third sub-bottom board 14 are connected in sequence. The first sub-bottom board 12, the second sub-bottom board 13, and the third sub-bottom board 14 are spliced in sequence in the length direction of the storage box 1. The at least one first connecting portion 112 comprises first connecting portions 112. The at least one second connecting portion 212 comprises second connecting portions 212. Two of first connecting portions 112 are respectively disposed on two opposite splicing sides of the second sub-bottom board 13. One of the second connecting portions 212 is disposed on a splicing side of the first sub-bottom board 12, and another one of the second connecting portions 212 is disposed on a splicing side of the third sub-bottom board 14.

In the embodiment, the bottom board 10 is formed by splicing the three sub-bottom boards together, which reduces a space occupied by the bottom board 10 during transportation or storage. In other embodiments, one of the first connecting portions 112 is disposed on a first side of the second sub-bottom board 13, and one of the second connecting portions 212 is disposed on a second side of the second sub-bottom board 13. A splicing side of the first sub-bottom board 12 and a splicing side of the third sub-bottom board 14 comprises a corresponding one of the first connecting portions or a corresponding one of the second connecting portions corresponding to splicing sides of the second sub-bottom board 13, which is not limited thereto.

As shown in FIG. 2, each of the front board 40, the back board 50, and the cover board 20 comprises the first board 100 and the second board 200. The first board 100 and the second board 200 of the front board 40 are respectively defined as a first sub-front board 41 and a second sub-front board 42. The first board 100 and the second board 200 of the back board 50 are respectively defined as a first sub-back board 51 and a second sub-back board 52. The first board 100 and the second board 200 of the cover board 20 are respectively defined as a first sub-cover board 21 and a second sub-cover board 22. The first sub-front board 41 and the second sub-front board 42, the first sub-back board and the second sub-back board 52, and the first sub-cover board 21 and the second sub-cover board 22 are all spliced and connected in the length direction of the storage box 1.

Figure 13:
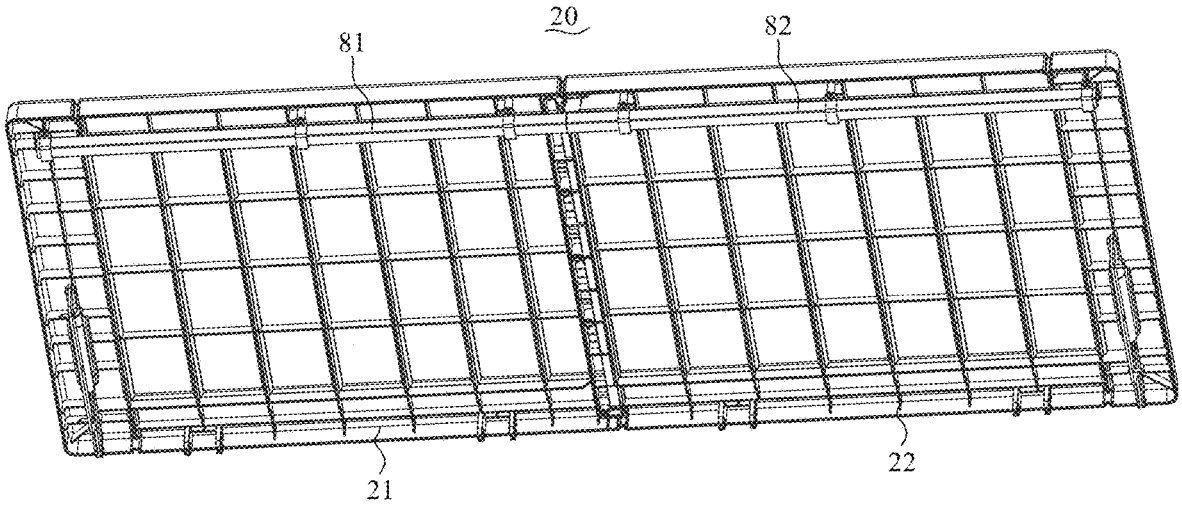
FIG. 13 is a schematic diagram of a cover board according to one embodiment of the present disclosure.

As shown in FIG. 13, in order to increase the structural strength of the cover board 20, the storage box 1 further comprises a first fixing rod 81 and a second fixing rod 82. The first fixing rod 81 is connected with the second fixing rod 82 in a plugging manner. The first fixing rod 81 is fixed to a bottom portion of the first sub-cover board 21, and the second fixing rod 82 is fixed to a bottom portion of the second sub-cover board 22. The first fixing rod 81 and the second fixing rod 82 are disposed on one side of the cover board 20 close to the front board 40. The first fixing rod 81 and the second fixing rod 82 are made of aluminum, iron, or alloy.

In a second aspect, the present disclosure provides the storage box 1. In order to improve the structural strength of the storage box 1, the present disclosure further improves the connection method between the boards. The bottom board 10 comprises at least two sub-bottom boards 11 connected with each other. For example, the bottom board 10 comprises three sub-bottom boards 11. At least one of the front board 40, the back board 50, the left side board 60, and the right side board 70 comprises at least two sub-boards spliced with each other. A splicing seam between the first sub-front board 41 and the second sub-front board 42 and the splicing seam between the first sub-back board 52 and the second sub-back board 52 are both located within the second sub-bottom board 13, while the splicing seam between the first sub-bottom board 12 and the second sub-bottom board 13 is located within the first sub-front board 41 and the second sub-back board 52. A splicing seam between the second sub-bottom board 13 and the third sub-bottom board 14 is within the second sub-front board 42 and the second sub-back board 52. In this way, the splicing seam between the two sub-front boards and the splicing seam between the two sub-back boards 50 are staggered from the splicing seams of the three sub-bottom boards 11. The splicing seam between the sub-front boards and the splicing seam between the two sub-back boards are connected by a corresponding one of the sub-bottom boards 11 of the bottom board 10. The splicing seams between the sub-bottom boards 11 are connected by a corresponding one of the sub-front boards of the front board 40 and a corresponding one of the sub-back boards of the back board 50. Such a cross-connection arrangement allows the boards of the storage box 1 to support each other, effectively transmitting and distributing external forces. The cross-connection arrangement further allows the entire storage box 1 to maintain a stable shape when subjected to the external forces, making it less susceptible to deformation or damage, and significantly enhancing the integrity of the storage box 1.

In a case where splicing seams of the sub-front boards, the sub-bottom boards 11, and the sub-back boards 50 overlap with each other, the splicing seams thereof easily cause localized deformation of the storage box 1 near the splicing seams, and the deformation gradually increases with continued external force. Instead, the cross-connection arrangement of the splicing seams, however, creates a stable frame structure through the mutual support of the boards of the storage box 1. When a certain part of the storage box 1 is subjected to the external force, the boards adjacent to the part constrain and support to limit deformation and improve stability.

As shown in FIG. 2, in some embodiments, in the length direction of the storage box 1, the splicing seam between the first sub-front board 41 and the second sub-front board 42 is aligned with the splicing seam between the first sub-back board 51 and the second sub-back board 52. A distance between the splicing seam formed by the first sub-front board and the second sub-front board and the splicing seam formed by the first sub-bottom board 12 and the second sub-bottom board 13 is equal to a distance between the splicing seam formed by the first sub-front board and the second sub-front board and the splicing seams formed by the second sub-bottom board 13 and the third sub-bottom board 14. The symmetrical and equidistant layout of the splicing seams allows the stress on the storage box 1 to be evenly distributed to the splicing seams and the boards when subjected to the external force.

As shown in FIG. 2, in some embodiments, in the length direction of the storage box 1, a size of the second sub-bottom board 13 is greater than a size of the first sub-bottom board 12 and a size of the third sub-bottom board 14. A size of the first sub-front board 41 is equal to a size of the second sub-front board 42.

Specifically, the size of the second sub-bottom board 13 is greater than the size of the first sub-bottom board 12 and the third sub-bottom board 14. The second sub-bottom board 13 acts like a main beam along a length direction thereof. The second sub-bottom board 13 provides more stable support for the splicing seam between the first sub-front board 41 and the second sub-front board 42 and the splicing seam between the first sub-back board 51 and the second sub-back boards 53. When the splicing seams are subjected to horizontal tension force or the shear force, the second sub-bottom board 13 effectively absorbs and distributes the forces, preventing loosening or cracking, thereby improving the stability and reliability of the connection between the boards. Furthermore, due to the greater size, the second sub-bottom board 13 is able to withstand greater weight. When the items of different weights and locations are placed inside the storage box 1, the second sub-bottom board 13 evenly distributes the weights, ensuring a more balanced load across the entire storage box 1. Even if the items are unevenly placed, the storage box 1 is not subjected to excessive stress in any area, avoiding tilt or deformation of the storage box 1, thereby improving the stability of the storage box under varying loads.

The size of the first sub-front board 41 is equal to the size of the second sub-front board 42. Such a design simplifies and streamlines mold design and manufacturing. Molds are manufactured to the same specifications, reducing the variety and complexity of molds and lowering mold manufacturing costs and time. Further, the standardized molds improve mold precision and quality, thereby ensuring consistent dimensions across all sub-front boards and increasing product yields.

As shown in FIGS. 11-12, in some embodiments, the storage box 1 further comprises at least one connecting rod 83. Each two adjacent sub-bottom boards 10 jointly define at least one receiving groove 16. Limiting portions 161 are disposed on two opposite side groove walls of each receiving groove 16. The at least one connecting rod 83 is installed in a corresponding receiving groove 16. The limiting portions 161 are configured to limit the at least one connecting rod 83 from detaching from the corresponding receiving groove 16. Each two sub-bottom boards 11 define the at least one receiving groove 16. The at least one connecting rod 83 is installed in the corresponding receiving groove 16. The limiting portions 161 on the side groove walls of each receiving groove 16 effectively prevent the at least one connecting rod 83 from separating. When the storage box 1 is subjected to the external forces, such as heavy objects squeezing or collisions, the at least one connecting rod 83 absorbs and distributes some of the stress, preventing separation or misalignment between the sub-bottom boards 11, which significantly enhances the security and connection stability of the sub-bottom boards 11, thereby increasing the structural strength of the entire storage box 1. Optionally, the at least one connecting rod 83 is no less than 5 cm and no more than 20 cm.

For instance, as shown in FIGS. 11-12, two receiving grooves 16 are defined between the first sub-bottom board 12 and the second sub-bottom board 13, and another two receiving grooves 16 are defined between the second sub-bottom board 13 and the third sub-bottom board 14. The receiving grooves 16 are spaced apart in the front-to-back direction. The at least one connecting rod comprises connecting rods 83. A combination of the receiving grooves 16 and the connecting rods 83 allows for the connection and reinforcement of the sub-bottom boards 11 from various locations, ensuring more uniform force distribution across the sub-bottom boards 11. When the storage box 1 is subjected to local external forces, the connecting rods 83 work together to resist deformation, effectively preventing the storage box 1 from denting or twisting due to excessive local forces, thereby enhancing the resistance of the storage box to deformation.

As shown in FIG. 11, in some embodiments, at least one of the sub-bottom boards 10 comprises finger slots 15, and each of the finger slots 15 is communicated with a corresponding receiving groove 16 and defines an inlet for operating a corresponding connecting rod 83. Each of the finger slots 15 is communicated with the corresponding receiving groove 16, providing the inlet for operating the corresponding connecting rod 83. When the user needs to remove or install each of the connecting rods 83, the user may insert a finger into a corresponding finger slot 15 to easily operate the corresponding connecting rod 83. A design of the finger slots 15 takes into account the needs of the user, making operation more convenient and comfortable, and improving a user experience.

In the drawings of the embodiments, the same or similar numbers correspond to the same or similar components; in the description of the present disclosure, it should be understood that terms such as "upper", "lower", "left", "right" etc. indicate direction or position relationships shown based on the drawings, and are only intended to facilitate the description of the present disclosure and the simplification of the description rather than to indicate or imply that the indicated device or element must have a specific direction or be constructed and operated in a specific direction. Therefore, the terms used to describe positional relationships in the drawings are only for illustrative purposes and cannot be construed as limitations of the present disclosure. For those of ordinary skill in the art, the specific meanings of the above terms can be understood according to specific circumstances.

The above are only optional embodiments of the present disclosure and are not intended to limit the present disclosure. Any modifications, equivalent substitutions, and improvements made within the spirit and principles of the present disclosure shall be comprised in the protection scope of the present disclosure.

What is claimed is:

1. A storage box, comprising:

a bottom board;

a cover board; and side enclosing boards connected between the bottom board and the cover board;

wherein the bottom board, the cover board and the side enclosing boards jointly enclose to form a storage space;

wherein at least one of the cover board, the side enclosing boards, and the bottom board comprises a first board and a second board spliced with the first board, a first splicing portion is disposed on a splicing side of the first board, a second splicing portion matched with the first splicing portion is disposed on a splicing side of the second board, the first splicing portion is spliced with the second splicing portion, and the first splicing portion overlaps the second splicing portion in a thickness direction;

wherein the first splicing portion comprises a first plate, the second splicing portion comprises a second plate, and the first plate and the second plate are overlapped in the thickness direction;

wherein at least one first connecting portion is disposed on the first plate, at least one second connecting portion is disposed on the second plate, and the at least one first connecting portion is connected with the at least one second connecting portion to fix the first plate to the second plate;

wherein the second plate is recessed in a direction away from the first plate to define a waterproof groove, the waterproof groove extends in a length direction of the second plate, the second plate further comprises a boss protruding from one side of the waterproof groove, and the at least one second connecting portion is connected in the boss;

wherein the first plate comprises a first protrusion portion, and the first protrusion portion is engaged in the waterproof groove.

2. The storage box according to claim 1, wherein the first plate further comprises a second protrusion portion, the first protrusion portion and the second protrusion portion are spaced apart to define a mounting groove therebetween, and the boss is connected in the mounting groove.

3. The storage box according to claim 1, wherein the at least one first connecting portion comprises at least one snapping portion disposed on the first plate, the at least one second connecting portion comprises at least one snapping groove disposed on the second plate, and the at least one snapping portion is snapped in the at least one snapping groove.

4. The storage box according to claim 3, wherein the at least one first connecting portion comprises at least one first fixing hole disposed on the first plate, and the at least one second connecting portion comprises at least one second fixing hole defined on the second plate;

wherein the storage box further comprises at least one fastener, and the at least one fastener passes through the at least one first fixing hole and the at least one second fixing hole to fix the first plate to the second plate.

5. The storage box according to claim 4, wherein the first plate comprises at least one first positioning portion, the second plate comprises at least one second positioning portion, the at least one first fixing hole is defined in the at least one first positioning portion, the at least one second fixing hole is defined in the at least one second positioning portion, the at least one first positioning portion is in positioning fit with the at least one second positioning portion, and the at least one first fixing hole is aligned with the at least one second fixing hole.

6. The storage box according to claim 4, wherein at least one of the at least one first fixing hole and the at least one second fixing hole is a threaded hole, and the at least one fastener is a screw.

7. The storage box according to claim 4, wherein the at least one snapping portion comprises a first hook and a second hook, and the first hook and the second hook are spaced apart in a length direction of the first plate, an orientation of the first hook is opposite to an orientation of the second hook, and the first hook and the second hook are hooked in the at least one snapping groove.

8. The storage box according to claim 7, wherein the at least one snapping portion comprises snapping portions, the at least one first fixing hole comprises first fixing holes, the snapping portions are disposed at intervals in the length direction of the first plate, and each of the first fixing holes is disposed between the first hook and the second hook of a corresponding one of the snapping portions.

9. The storage box according to claim 1 wherein the bottom board comprises a first sub-bottom board, a second sub-bottom board, and a third sub-bottom board;

wherein the first sub-bottom board, the second sub-bottom board, and the third sub-bottom board are connected in sequence, the at least one first connecting portion comprises first connecting portions, the at least one second connecting portion comprises second connecting portions, two of the first connecting portions are respectively disposed on two opposite splicing sides of the second sub-bottom board, one of the second connecting portions is disposed on a splicing side of the first sub-bottom board, and another one of the second connecting portions is disposed on a splicing side of the third sub-bottom board.

10. The storage box according to claim 1, wherein the storage box is disposed in a cuboid shape, the side enclosing boards comprise a front board and a back board, and each of the front board, the back board, and the cover board comprises the first board and the second board.

11. The storage box according to claim 10, wherein the cover board comprises a first sub-cover board and a second sub-cover board, wherein the storage box further comprises a first fixing rod and a second fixing rod, the first fixing rod is connected with the second fixing rod in a plugging manner, the first fixing rod is fixed to a bottom portion of the first sub-cover board, and the second fixing rod is fixed to a bottom portion of the second sub-cover board.

12. A storage box, comprising:

a bottom board;

a cover board; and side enclosing boards connected between the bottom board and the cover board, wherein the bottom board, the cover board and the side enclosing boards are enclosed to form a storage space;

wherein the bottom board comprises at least two sub-bottom boards spliced with each other, at least one of the side enclosing boards comprises at least two sub-boards spliced with each other, and a splicing seam between the at least two sub-boards is staggered with a splicing seam between the at least two sub-bottom boards;

wherein the storage box further comprises at least one connecting rod, each two adjacent sub-bottom boards jointly define at least one receiving groove, limiting portions are disposed on two opposite side groove walls of the at least one receiving groove, the at least one connecting rod is installed in the at least one receiving groove, and the limiting portions are configured to limit the at least one connecting rod from detaching from the at least one receiving groove.

13. The storage box according to claim 12, wherein the side enclosing boards comprise a front board and a back board, the front board comprises at least two sub-front boards spliced with each other, and the back board comprises at least two sub-back boards spliced with each other;

wherein a splicing seam between the at least two sub-front boards is staggered with a splicing seam between the at least two sub-bottom boards, and the splicing seam between the at least two sub-back boards is staggered with the splicing seam between the at least two sub-bottom boards.

14. The storage box according to claim 13, wherein the bottom board comprises a first sub-bottom board, a second sub-bottom board, and a third sub-bottom board;

wherein the first sub-bottom board, the second sub-bottom board, and the third sub-bottom board are connected in sequence, the front board comprises a first sub-front board and a second sub-front board, and the back board comprises a first sub-back board and a second sub-back board;

wherein the splicing seam between the first sub-front board and the second sub-front board and the splicing seam between the first sub-bottom board and the second sub-bottom board are within the second sub-bottom board.

15. The storage box according to claim 14, wherein in a length direction of the storage box, the splicing seam between the first sub-front board and the second sub-front board is aligned with the splicing seam between the first sub-back board and the second sub-back board;

wherein a distance between the splicing seam formed by the first sub-front board and the second sub-front board and the splicing seam formed by the first sub-bottom board and the second sub-bottom board is equal to a distance between the splicing seam formed by the first sub-front board and the second sub-front board and the splicing seams formed by the second sub-bottom board and the third sub-bottom board.

16. The storage box according to claim 14, wherein in the length direction of the storage box, a size of the second sub-bottom board is greater than a size of the first sub-bottom board and a size of the third sub-bottom board, and a size of the first sub-front board is equal to a size of the second sub-front board.

17. The storage box according to claim 12, wherein at least one of the sub-bottom boards comprises a finger slot, and the finger slot is communicated with the at least one receiving groove and defines an inlet for operating the at least one connecting rod.

* * * * *